US006131771A

United States Patent [19]

Hanna

[11] Patent Number: 6,131,771

[45] Date of Patent: Oct. 17, 2000

[54] FLUID DISPENSING SYSTEM WITH FLOW CONTROL

[75] Inventor: Emmanuel A. Hanna, Lakeview Terrace, Calif.

[73] Assignee: Bobrick Washroom Equipment, Inc., North Hollywood, Calif.

[21] Appl. No.: 09/326,178

[22] Filed: Jun. 4, 1999

[51] Int. Cl.[7] ..... B67D 5/52

[52] U.S. Cl. ..... 222/136; 222/96; 222/145.1; 222/380

[58] Field of Search ..... 222/94, 96, 136, 222/145.1, 185.1, 380

[56] References Cited

U.S. PATENT DOCUMENTS

| | | | |
|---|---|---|---|
| 3,531,018 | 9/1970 | Richterich | 222/136 |
| 4,601,409 | 7/1986 | DiRegolo | 222/145.1 |
| 4,976,851 | 12/1990 | Tanokura et al. | 222/96 |

FOREIGN PATENT DOCUMENTS

| | | | |
|---|---|---|---|
| 282734 | 11/1934 | Italy | 222/145.1 |

*Primary Examiner*—Joseph A. Kaufman

*Attorney, Agent, or Firm*—Pretty, Schroeder & Poplawski, P.C.

[57] ABSTRACT

A system for dispensing liquids, particularly a system for dispensing liquid soap through at least one hand-operated pump. The system includes a pump, a main reservoir for holding a first quantity of the fluid to be dispensed, and an auxiliary reservoir for holding a second and generally smaller quantity of fluid. The main reservoir, auxiliary reservoir, and pump are in fluid communication with one another through a coupling. The system and coupling are configured so that the fluid is drawn preferentially from the main reservoir, with fluid being drawn from the auxiliary reservoir only when the main reservoir is substantially emptied of fluid. Additionally, any fluid that is drawn from the auxiliary reservoir will be replenished automatically by fluid in the main reservoir as long as any fluid is present in the main reservoir.

12 Claims, 2 Drawing Sheets

FLUID DISPENSING SYSTEM WITH FLOW CONTROL

BACKGROUND OF THE INVENTION

The invention relates generally to apparatus and methods for controlling the flow of fluids through a fluid dispensing system. More particularly, the invention provides a coupling and tubing arrangement configured to control the flow of liquid soap inside a soap dispensing system wherein the system includes a main soap reservoir, an auxiliary bladder reservoir and at least one pump for dispensing soap to a user.

Liquid soap dispensing systems are frequently installed in commercial and industrial restrooms. Systems of this general type commonly include at least one hand-operated pump operable to dispense liquid to a user of the system. The soap is generally supplied to the pump from some kind of reservoir. The reservoir holds a fairly large quantity of liquid soap so that a supply of the soap is continuously available. This type of system requires periodic inspection so that the reservoir can be refilled or replaced before it becomes empty. If the reservoir becomes empty, the soap will not be available when a user wants to use the system.

Very commonly, these systems will use a disposable reservoir that comes from the manufacturer pre-filled with soap. When the reservoir becomes empty, it is simply discarded and replaced with a new one. This arrangement insures a convenient supply of soap while avoiding much of the mess, inconvenience, and risk of contamination that would be present in systems using refillable reservoirs.

A disposable reservoir system is less than ideal in one important respect however. It is very undesirable in such a system that the reservoir ever become completely empty. If the reservoir is empty, soap will not be available to users of the system. Because the person maintaining the system cannot watch the reservoir continuously, that person cannot be there to replace the reservoir precisely when it runs out of soap. The person must therefore replace the reservoir at some point before it becomes empty. This means that considerable soap is wasted, with attendant needless expense and disposal problems.

To remedy this, a second reservoir is sometimes included to provide a supply of soap should the first reservoir become empty. When the first reservoir is empty, soap is drawn from the second reservoir until such time as the first reservoir can be refilled or replaced. Often, the first and second reservoir are identical and interchangeable. This configuration is less than ideal, however, because this scheme requires the system to be inspected and maintained more often than would ideally be the case.

It would be preferable to devise a system in which a relatively large main reservoir served as the main supply of soap to the system. This relatively large main reservoir, holding a relatively large quantity of soap, would require only relatively infrequent inspection and replacement. A comparatively small auxiliary reservoir could be provided to act as a reserve supply to ensure an uninterrupted supply of soap after the main reservoir becomes empty and before the main reservoir can thereafter be inspected and replaced.

In this type of two reservoir system it will be desirable that soap be dispensed first from the main reservoir, with soap being drawn from the auxiliary reservoir only when the main reservoir is substantially empty. It will be further desirable that after the previously emptied main reservoir is replaced, soap will flow automatically from the main reservoir into the auxiliary reservoir to replenish the reserve supply held in the smaller auxiliary reservoir.

Flow control to accomplish these goals might be provided in the form of one or more mechanical or electromechanical valves. But such valves, while generally well-known to those skilled in design and construction of fluid handling systems, are less than ideal for this application. Mechanical and electromechanical valves are prone to failure through jamming or plugging, for example. These types of valves are also complex and somewhat expensive for use in this kind of simple, widely-used system. Finally, electromechanical valves require a power supply to operate them and are thus expensive and prone to failure due to power interruption.

It would be highly desirable, therefore, to provide an improved system for controlling the flow of soap between a main reservoir, an auxiliary reservoir and a dispensing pump. The improved system should be simple, inexpensive and highly reliable with little or no maintenance. The present invention is embodied in such a system.

Although a preferred embodiment of the invention is described herein in the form of a user operable soap dispensing system, the invention may find use as well in any fluid handling system in which fluid is moved between main and auxiliary reservoirs and a pump or another outlet for the fluid. Thus, although a preferred embodiment is described in the form of a soap dispensing system, the scope of the invention is not so limited and no such limitation is implied herein.

SUMMARY OF THE INVENTION

The invention is embodied in a system for dispensing fluids, and more particularly in a soap dispensing system for dispensing soap through one or more hand-operated pumps. The system includes a main reservoir for holding a quantity of the soap or other fluid to be dispensed, and an auxiliary reservoir for holding a generally smaller quantity of the same fluid as a reserve for times when the main reservoir is depleted. The main reservoir, the auxiliary reservoir, and at least one pump are connected together with fluid communication between them provided by a coupling.

In a preferred embodiment of the invention, fluid conduits between the main reservoir and the coupling and between the pump and the coupling, have flow areas that are greater than the flow area of a fluid conduit between the auxiliary reservoir and the coupling. Fluid is thereby drawn preferentially from the main reservoir as long as fluid remains in the main reservoir, with fluid being drawn from the auxiliary reservoir only after the fluid in the main reservoir is substantially exhausted. In the preferred embodiment, fluid in the main reservoir will automatically flow to replenish any liquid that is drawn from the auxiliary reservoir so that the auxiliary reservoir remains substantially full as long as fluid is present in the main reservoir. Other features and advantages of the present invention will become apparent from the following detailed description of the preferred embodiment, taken in conjunction with the accompanying drawings, which illustrate by way of example the principles of the invention.

BRIEF DESCRIPTION OF THE DRAWINGS

The construction and operation of the invention are described in detail in conjunction with the figures included herewith, in which.

DESCRIPTION OF THE PREFERRED EMBODIMENTS

Figure 1:
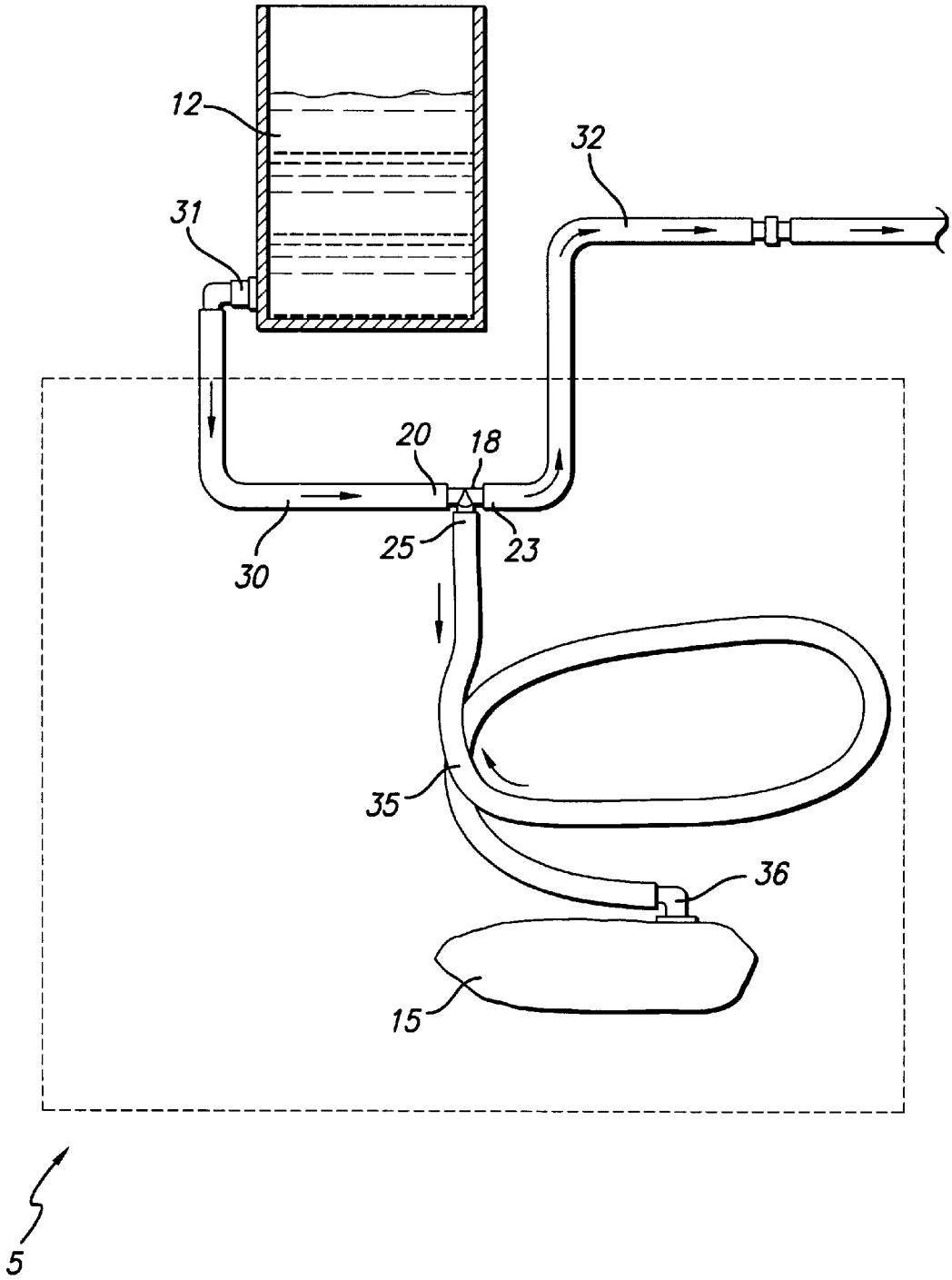
FIG. 1 is a semi-schematic depiction of a soap dispensing apparatus embodying the flow control system of the invention.

FIG. 1 is a semi-schematic depiction of soap dispensing apparatus 5, which includes the flow control system of the present invention. The invention includes a hand-operated, relatively low pressure pump 10. This type of pump is conventional in the art and is operable by a user of the system to dispense soap onto the user's hands. This disclosure describes a system having a single pump. However, alternative systems may be constructed in which a single main reservoir feeds a plurality of similar pumps.

The pump 10 is supplied with soap from a main reservoir 12. In a preferred embodiment, the main reservoir is a disposable soap container holding either seven or twelve liters of liquid hand soap. The system further includes an auxiliary reservoir 15, which is configured and connected to hold a second, generally somewhat smaller quantity of soap in comparison with the main reservoir. The auxiliary reservoir may be in the form of a flexible polymeric bladder, as is suggested by the figures. In a preferred embodiment, the bladder has a capacity of about 2 liters.

Figure 2:
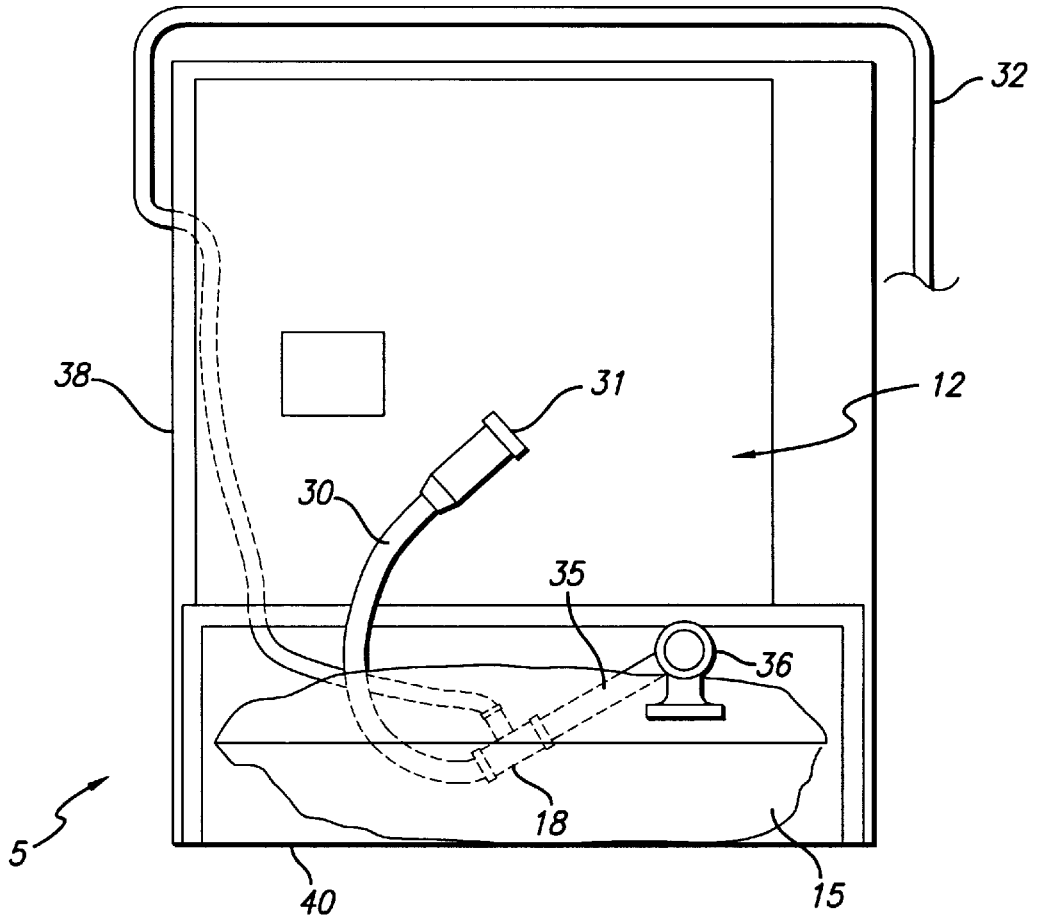
FIG. 2 is a side view of a soap dispensing system like that depicted in FIG. 1.

The major components of the system, the pump 10, the main reservoir 12 and the auxiliary reservoir 15, are all coupled to one another by flexible rubber or synthetic rubber hoses, which connect together through a three-way coupling 18. The three-way coupling is shown in FIGS. 1 and 2; details of the coupling can be seen best in FIG. 3.

The 3-way coupling 18 includes a first connector port 20, a second connector port 23 and a third connector port 25. Each of these connector ports has a plurality of retaining ridges 27 for holding flexible tubing on the connector port, even with considerable pressure inside the tubing. Each of these connector ports is in fluid communication with the other two so that fluid may flow between any of the connector ports depending on conditions inside the system.

In a preferred embodiment of the invention, the first and second connector ports 20 an 23 have inside diameters somewhat greater than the inside diameter of the third connector port 25. In this embodiment, the first and second connector ports have inside diameters of three-eighths of an inch (approx. 9.5 mm), while the third connector port has an inside diameter of one-fourth of an inch (approx. 6.4 mm). Thus, the first and second connector ports have an internal flow area through them that is 2.25 times that of the third connector port.

Figure 3:
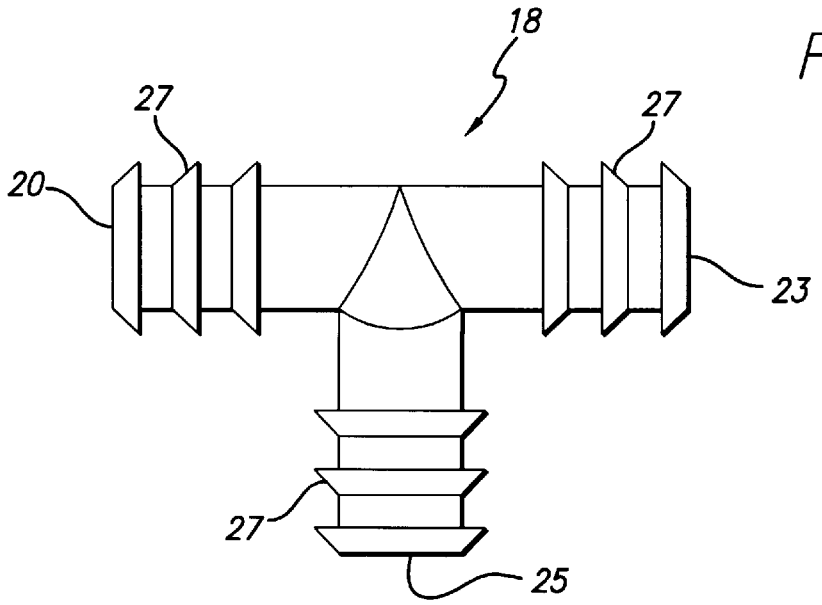
FIG. 3 is a side view of a three-way coupling used in the system shown in FIGS. 1 and 2.

The three-way coupling 18 shown in FIG. 3 has three connector ports. Other configurations with more connector ports might also be used. For example, a coupling with four or more connector ports could connect to more than one soap dispenser, more than one of either type of reservoir, or virtually any conceivable combination.

Referring mainly to FIG. 1, the main reservoir 12 is connected to the first connector part 20 of the 3-way coupling 18 through a first fluid conduit 30. The first fluid conduit connects to the main reservoir at a main reservoir connector 31. The pump 10 is connected to the second connector port 23 through a second fluid conduit 32. The auxiliary reservoir 15 is connected to the third, smaller connector port 25 through a third fluid conduit 35, which connects to the auxiliary reservoir at an auxiliary reservoir connector 36. Each of these fluid conduits is in the form of a length of flexible, generally synthetic rubber tubing. Each length of tubing has an inside diameter substantially equal to that to the connector port it connects to, i.e., either three-eighths or one-fourth of an inch.

The tubing must be of sufficient strength to avoid collapsing on the one hand or bursting on the other under the pressures present in the system. The tubing must have sufficient flexibility to slide over the retaining ridges 27 of the connector ports and connectors of the system's various components. At the same time, the tubing must be sufficiently stiff so that it is not forced off the connector ports and connectors by pressure in the system. In the preferred embodiment, plastic snap-on retaining clamps (not shown) are used to secure the various lengths of tubing over their respective connector ports and connectors.

Referring principally now to FIG. 2, the main reservoir 12 and the auxiliary reservoir 15 are housed inside a dispenser shell 38. The dispenser shell is typically adapted for mounting onto a wall in the vicinity of a sink or wash basin (not shown). The bladder-like auxiliary reservoir 15 lies on a floor 40 at the bottom of the shell. The main reservoir 12 sits on a shelf 43, which in the preferred embodiment is some two-and-one-half to three inches (63–76 mm) above the surface of the floor that holds the auxiliary reservoir. The main reservoir, which may be in the form of a 7-liter or a 12-liter soap tank, can typically contain a quantity of soap that is about ten to eleven inches (25–28 cm) high above the bottom of the tank when the tank is full.

In the preferred embodiment, the three-eighths inch (9.5 mm) internal diameter first fluid conduit 30 is a maximum of about 10 inches (25 cm) in length between the main reservoir connector 31 and the first connector port 20 of the 3-way coupling 18. For its part, the one-fourth inch (6.4 mm) inside diameter third fluid conduit 35 is some five feet (150 cm) long between the third connector port 25 of the 3-way coupling and the auxiliary reservoir connector 36.

The system's dimensions can be significant to the proper functioning of the system. In particular, the lengths of the first and third fluid conduits; the internal diameters of the various tubings, connector ports, and connectors; and the maximum height of the soap inside the main reservoir 12 over that of the soap in the auxiliary reservoir 15, are all believed by the inventor to be relatively significant. In contrast, the proper functioning of the system is believed to be relatively insensitive to the length of the second fluid conduit 32, or the relative height of the pump 10. The system as described herein has been found to work with a second fluid conduit having a length up to fifty feet to dispense liquid soap having a viscosity of up to about 1200 centipoise. As those skilled in the art will readily appreciate, a pump generating sufficient suction is required. However, a wide range of such pumps is readily available and selection of an appropriate pump will not present undue difficulty to one skilled in the art.

The system as described herein has been found to be usable without modification with a variety of commercially available liquid soaps, even though these soaps vary somewhat in density and viscosity. Although these properties do effect the way in which the liquid moves through the system, these effects are proportional throughout the system so that the overall functioning of the system is preserved. This is an advantage in that any one of many widely available soaps may be used without physical modification to the dispensing system itself.

The configuration of the preferred embodiment is advantageous in that soap will be drawn preferentially from the main reservoir 12 when the pump 10 is operated and there is soap in both the main reservoir and the auxiliary reservoir 15. When the pump is operated, a negative pressure condition (partial vacuum) is created within the second fluid conduit 32, which runs between the pump and the second connector port 23 of the 3-way coupling 18. The resulting suction draws soap from the coupling.

As soap is drawn by the pump 10 from the 3-way coupling 18, more soap must flow into the coupling to replace that drawn by the pump. This replacement soap can come either from the main reservoir 12 through the first fluid conduit 30, or from the auxiliary reservoir 15 through the third fluid conduit 35. The inventor has found that when the system is configured as described herein, soap will be drawn substantially only from the main reservoir as long as any appreciable quantity of soap remains in the main reservoir.

Because the first fluid conduit 30 is has a significantly greater diameter and a much shorter length than the third fluid conduit 35, the internal flow resistance through the first fluid conduit is much less than the internal flow resistance through the third fluid conduit. The flow resistance through a conduit can be defined as the relative ease with which a fluid is drawn through a conduit. This relative flow resistance will increase as the cross-sectional area of a conduit is decreased, i.e., it is more difficult to draw fluid through a thinner conduit. The flow resistance increases as well with longer conduits. In the preferred embodiment, the first fluid conduit has an internal flow area 2.25 times that of the third fluid conduit and is only about one sixth its length. This means that the flow resistance through the first fluid conduit is much less than the flow resistance through the third fluid conduit. Other system characteristic, e.g., variable internal surface roughness in the conduits, may also affect the relative flow resistances inside the system. The flow resistance of the conduits might be varied as well by installing a choke or a similar restriction in one or more of the conduits.

As the pump 10 is operated, suction is created in the second fluid conduit 32 and at the second connector port 23 of the 3-way coupling 18. This suction draws soap from the 3-way coupling into the second fluid conduit. As soap is drawn out of the 3-way coupling, soap must flow into the coupling to replace it. This soap may be drawn either from the first fluid conduit 30 and the main reservoir 12, or from the third fluid conduit 35 and the auxiliary reservoir 15.

Because the internal flow resistance of the first fluid conduit 30 is so much less than that of the third fluid conduit 35, the soap drawn into the 3-way coupling 18 comes overwhelmingly from the first fluid conduit and the main reservoir 12. Little or no soap is drawn from the third fluid conduit and thus the auxiliary reservoir 15 remains substantially full.

Under extreme conditions of heavy demand, e.g., when a large number of pumps 10 connected to the same system are being operated at once, some soap may in fact be drawn from the auxiliary reservoir 15. However, this soap is expected to be relatively small in quantity even under the most extreme conditions. Moreover, any soap that is drawn from the auxiliary reservoir will be automatically replenished with soap from the main reservoir 12. This replenishment will be described in more detail below.

As long as soap is present in the main reservoir 12, soap will be drawn substantially only from that reservoir and the auxiliary reservoir 15 will remain substantially completely full. As the system is used further and soap continues to be drawn by the pump 10, the main reservoir 12 may eventually become substantially empty. When the main reservoir becomes empty, suction created by the pump will then draw soap from the auxiliary reservoir 15.

Pumping of soap from the auxiliary reservoir 15 may then continue until the auxiliary reservoir is itself emptied and substantially no soap remains in the system. Preferably though, the main reservoir 12 will be refilled, or in the preferred embodiment, replaced, while some soap still remains in the auxiliary reservoir. In either case, when soap is again present in the main reservoir, soap will then flow from the main reservoir to replenish that drawn from the auxiliary reservoir. This automatic replenishment of soap drawn from the auxiliary reservoir with soap from the main reservoir will also occur in the event that soap is drawn from the auxiliary reservoir under conditions of extreme demand as described above.

The system described herein combines a relatively large main reservoir 12 with a relatively small auxiliary reservoir 15. The relatively large main reservoir means that the system will require inspection and refilling relatively infrequently, with the relatively small capacity auxiliary reservoir holding a reserve quantity of soap for use between the time at which the main reservoir becomes empty and the time at which it can be refilled or replaced. The presence of the auxiliary reservoir allows the main reservoir to be completely emptied while the system remains functional with soap still available to the user. Unnecessary waste of soap is thereby avoided.

A preferred embodiment of a fluid dispensing system incorporating the invention has been described herein in detail. Modifications and additions to this preferred system will no doubt occur to those skilled in the art. For example, changes may be made in the relative sizes, positions and operating characteristics of various parts of the system. These changes may require that changes be made to other components to maintain the system's functioning as described herein. However, any necessary changes should be readily achievable by those skilled in the art. Moreover, although the preferred embodiment is in the form of a liquid soap dispensing system, it should be readily apparent that the invention may be equally applicable to systems for dispensing fluids other than soap. Further applications, additions and modifications may occur to those skilled in the art. The invention is not to be limited to the preferred embodiment described herein. Rather, the scope of the invention should be determined by reference to the following claims, along with the full scope of equivalents to which those claims are legally entitled.

What is claimed is:

1. A system for dispensing a fluid, the system comprising:

a main reservoir;

an auxiliary reservoir;

a pump operable to dispense fluid from the system;

a coupling comprising a first connector port, a second connector port, and a third connector port, each of the three connector ports being in fluid communication with the other two connector ports;

a first fluid conduit providing fluid communication between the first connector port and the main reservoir;

a second fluid conduit providing fluid communication between the second connector port and the pump; and a third fluid conduit providing fluid communication between the third connector port and the auxiliary reservoir;

wherein each of said first, second and third fluid conduits has an internal flow area, and wherein the internal flow area of the third fluid conduit is less than that of the internal flow area of at least one of the first and second fluid conduits.

2. The system of claim 1, wherein the internal flow area of the third fluid conduit is less than the internal flow area of both of the first and second fluid conduits.

3. The system of claim 2, wherein the internal flow area of the third fluid conduit is less than half that of at least one of the first and second fluid conduits.

4. The system of claim 3, wherein the internal flow area of the third fluid conduit is less than half that of both of the first and second fluid conduits.

5. The system of claim 1, wherein the first, second and third fluid conduits each has an internal diameter, and wherein the internal diameter of the third fluid conduit is less than the internal diameter of at least one of the first and second fluid conduits.

6. The system of claim 5, wherein the internal diameter of the third fluid conduit is less than the internal diameter of both of the first and second fluid conduits.

7. A system for dispensing a fluid, the system comprising:

a main reservoir;

an auxiliary reservoir;

a pump operable to dispense fluid from the system;

a coupling comprising a first connector port, a second connector port, and a third connector port, each of the three connector ports being in fluid communication with the other two connector ports;

a first fluid conduit providing fluid communication between the first connector port and the main reservoir;

a second fluid conduit providing fluid communication between the second connector port and the pump; and a third fluid conduit providing fluid communication between the third connector port and the auxiliary reservoir;

wherein each of the first and third fluid conduits has an internal flow resistance, and wherein the internal flow resistance of the third fluid conduit is greater than that of the first fluid conduit.

8. The system of claim 7, wherein each of the first, second and third fluid conduits has an internal flow area and wherein the internal flow area of the third fluid conduit is less than the internal flow area of both of the first and second fluid conduits.

9. The system of claim 8, wherein the internal flow area of the third fluid conduit is less than half that of at least one of the first and second fluid conduits.

10. The system of claim 9, wherein the internal flow area of the third fluid conduit is less than half that of both of the first and second fluid conduits.

11. The system of claim 7, wherein the first, second and third fluid conduits each have an internal diameter, and wherein the internal diameter of the third fluid conduit is less than the internal diameter of at least one of the first and second fluid conduits.

12. The system of claim 11, wherein the internal diameter of the third fluid conduit is less than the internal diameter of both of the first and second fluid conduits.

* * * * *